US006749664B1

(12) United States Patent
Hoffman et al.

(10) Patent No.: US 6,749,664 B1
(45) **Date of Patent: *Jun. 15, 2004**

(54) FURNACE HEARTH FOR IMPROVED MOLTEN IRON PRODUCTION AND METHOD OF OPERATION

(75) Inventors: Glenn E. Hoffman, Lancaster, SC (US); David C. Meissner, Charlotte, NC (US); Kyle J. Shoop, Pittsburg, PA (US)

(73) Assignee: Midrex International, B.V., Rotterdam, Zurich Branch, Zurich (CH)

( * ) Notice: Subject to any disclaimer, the term of this patent is extended or adjusted under 35 U.S.C. 154(b) by 161 days.

This patent is subject to a terminal disclaimer.

(21) Appl. No.: 10/056,131

(22) Filed: Jan. 24, 2002

Related U.S. Application Data

(60) Provisional application No. 60/264,502, filed on Jan. 26, 2001.

(51) Int. Cl.[7] ..... C21B 13/10

(52) U.S. Cl. ..... 75/484; 75/500; 266/177; 266/190

(58) Field of Search ..... 75/484, 500; 266/177, 266/190

(56) References Cited

U.S. PATENT DOCUMENTS 4,701,214 A 10/1987 Kaneko et al.
5,730,775 A 3/1998 Meissner et al.
6,214,087 B1 * 4/2001 Hoffman et al. ..... 75/500
6,413,295 B2 * 7/2002 Meissner et al. ..... 75/484
2001/0052273 A1 * 12/2001 Meissner et al. ..... 75/484

* cited by examiner

*Primary Examiner*—Melvyn Andrews
(74) *Attorney, Agent, or Firm*—Dougherty, Clements & Hofer

(57) ABSTRACT

An apparatus and method for the direct reduction of iron oxide utilizes a hearth furnace having a vitreous hearth layer of conditioning materials, with the vitreous hearth layer introduced onto a refractory surface of the furnace. The vitreous hearth layer may have upper layers of coating compounds including carbonaceous materials, onto which iron oxide feed material is placed with the carbonaceous materials assisting with segregating the reduced molten iron nuggets from the vitreous hearth layer. The conditioning materials may include compounds such as silicon oxide, magnesium oxide, iron oxides, and aluminum oxide. The conditioning materials are placed in solid or liquid form on the refractory surface, which allows the conditioning materials to raise the melting temperature of the vitreous hearth layer onto which the coating compounds and iron oxide materials are placed. The iron oxide materials form molten metal nuggets of high purity iron and residual carbon, which remains separate from the vitreous hearth layer due to the layer of coating compounds. The invented apparatus and method of operation provide a solid iron and carbon product having high iron purity, which is discharged from the furnace without significant loss of iron onto the interior surfaces of the hearth furnace, and with limited buildup of hardened films of metallized iron product within the hearth.

32 Claims, 3 Drawing Sheets

Fig.4
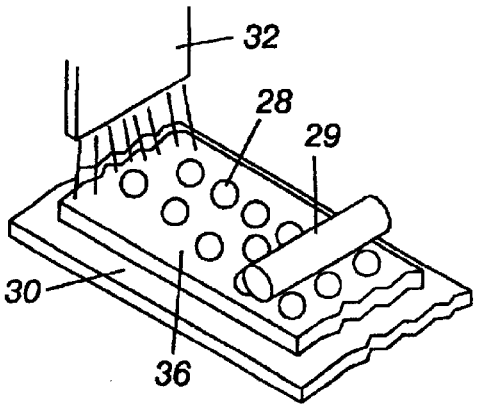
Fig.5
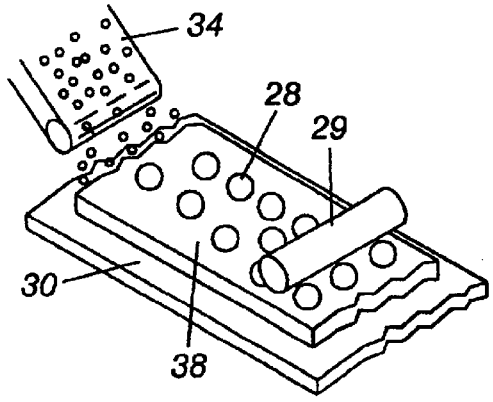
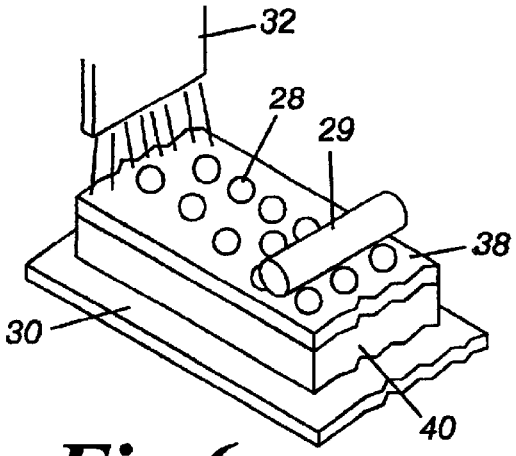
Fig.6
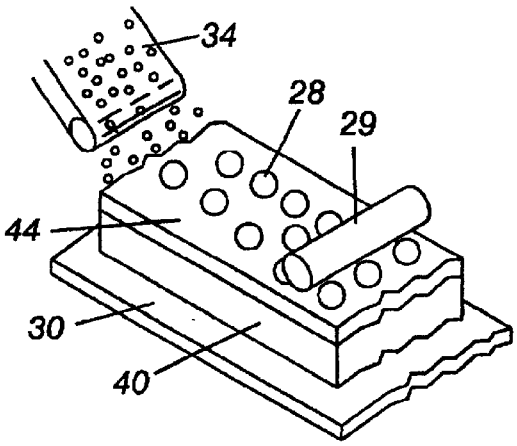
Fig.7
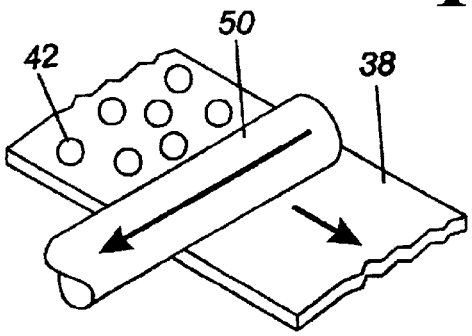
Fig.8

FURNACE HEARTH FOR IMPROVED MOLTEN IRON PRODUCTION AND METHOD OF OPERATION

CROSS REFERENCE TO RELATED APPLICATIONS

This application claims the benefit of U.S. Provisional Application No. 60/264,502, filed Jan. 26, 2001, co-pending U.S. patent application Ser. No. 09/272,276, filed Mar. 19, 1999, which has subsequently issued as U.S. Pat. No. 6,214,087 on Apr. 10, 2001; U.S. Provisional Application No. 60/264,502; and co-pending U.S. patent application Ser. No. 09/266,989, filed Mar. 12, 1999, which has subsequently issued as U.S. Pat. No. 6,413,295 on Jul. 2, 2002.

FIELD OF INVENTION

The present invention relates to an apparatus and method for introducing materials into an ore processing furnace for improved reduction of iron oxide. More particularly, this invention relates to the composition of materials introduced into a furnace for increasing/controlling the melting point of hearth compounds and for coating the hearth surface to improve the reduction and metallization of iron oxide.

BACKGROUND OF THE INVENTION

Steel, by definition, is a combination of iron with a small amount of carbon and other materials. Iron does not occur in nature in its useful metallic form. Metallic iron, from which steel is derived, much be extracted from iron ore. Generally, the ratio of metallic iron to total iron is termed metallization.

All steelmaking processes require the input of iron bearing materials as process feedstocks. For making steel in a basic oxygen furnace, the iron bearing feed materials are usually blast furnace hot metal and steel scrap. A broadly used iron source is a product known as Direct Reduced Iron ("DRI") which is produced by the solid state reduction of iron ore to highly metallized iron without the formation of liquid iron.

A common problem with current methods for producing metallized iron product is the loss of purified metallized iron within the furnace at elevated temperatures. Additionally, the current methods for obtaining increased volumes and a higher quality of metallized iron product from rotary hearth furnaces involve significant expenditures, increased processing time, and/or excessive furnace temperatures.

In 1987, Midrex received U.S. Pat. No. 4,701,214, that taught reduction in a rotary hearth furnace and a method of operation in which finely divided iron oxide and carbonaceous material is devolatized, with a substantial portion being reacted, forming hot, highly reduced iron containing some carbon for feed material for additional smelting and refining.

U.S. Pat. No. 5,730,775 teaches a method and apparatus for producing direct reduced iron from dry iron oxide and carbon compacts that are placed no more than two layers deep onto a rotary hearth, and are metallized by heating the compacts to temperatures of approximately 1316° to 1427° C., for a short time period. For a general understanding of the recent art, U.S. Pat. No. 5,730,775 is incorporated herein by reference.

Because of the problems of the prior art, a need therefore exists for an apparatus and method of operation for efficiently producing increased volumes and a higher quality of metallized iron product from rotary hearth furnaces without significant increases in cost, processing time, or excessive furnace temperatures.

While there are numerous methods and means for producing increased volumes and higher quality metallized iron product from rotary hearth furnaces, none are known to have a similar structure to, or to function in the manner of the present invention.

SUMMARY OF THE INVENTION

Direct reduction of iron oxide in furnaces utilizing the invented apparatus and method improves the utilization of a hearth furnace by providing a moving hearth with a refractory base layer thereon and a vitreous hearth layer on the refractory base layer. The vitreous hearth layer is composed of conditioning materials that increase the melting point of the vitreous layer onto which iron oxide pellets are placed. The conditioning materials may be provided as multiple layers on the base layer, with an upper layer or coating of non-wetting graphite compounds. Multiple vitreous hearth layers may contain components that increase the melting point of the vitreous hearth layers, and may include upper layers of carbon or carbon compounds that reduce the adherence of liquified iron and carbon to the vitreous hearth layer, thereby improving the efficiency of the direct reduction of iron oxide feed material to metallized iron discharged from the furnace.

The present invention is an improved hearth apparatus and a method of operation that provides conditioning materials that may include compounds such as magnesium oxide compounds, silicon oxide compounds, aluminum oxide compounds, iron oxide compounds, and a carbon compound source that are introduced in layers onto a refractory base layer, and are melted to form vitreous hearth layers. An additional upper coating layer of carbonaceous materials is added and iron oxide pellets are placed for reduction. The invention provides for the production of increased volumes of product and a higher quality carbon-containing metallized iron product than previously available. The iron product is separated from slag in the furnace without significant increases in costs, processing time, or excessive furnace temperatures over prior known processes.

OBJECTS OF THE INVENTION

The principal object of the present invention is to provide a method of achieving efficient reduction of iron oxide to metallized iron at elevated temperatures in a processing and reducing furnace having a hearth surface, preferably a moving hearth.

It is also an object of this invention to provide a method of achieving efficient reduction of iron oxide at elevated temperatures in a processing and reducing furnace which allows ease of removal of metallized iron oxide from the hearth surface.

Another object of the invention is to provide an improved furnace apparatus for introducing refractory surface conditioning material onto the base layer of the furnace.

Another object of the invention is to provide an improved hearth furnace method of operation which provides hearth conditioning materials forming solidified vitreous hearth layers at high temperatures utilized for producing metallizing iron material.

An additional object of the invention is to provide a method of operation of a rotary hearth furnace including applying conditioning materials on a refractory surface, with placement of coating layers providing ease of removal of metallized iron product from the vitrified hearth surface.

The objects of the invention are met by a method for producing direct reduced, purified, metallized iron at elevated temperatures within a furnace, including the step of providing a furnace having a refractory layer, introducing conditioning materials on the refractory layer, heating the conditioning materials to form a vitreous layer on the refractory layer, and placing a coating layer on the vitreous layer. Iron oxide materials are placed on the coating layer, exposed to elevated temperatures, and reduced to purified metallized iron nuggets, which are discharged from the furnace.

The objects of the invention are also met by an apparatus for producing direct reduced metallized iron at elevated temperatures within a furnace, the furnace having a refractory layer with a means for introducing conditioning materials on the refractory layer. The conditioning materials include carbonaceous materials including a mixture of magnesium oxide, silicon oxide, aluminum oxide compounds, iron oxide compounds and a carbon source, placed in multiple layers on the refractory layer. The conditioning materials are heated to form vitreous hearth layers. A carbon coating layer is applied to the vitreous hearth layers, and iron oxide feed materials are placed on the coating layer. The iron oxide materials are heated by a radiant heat source within the furnace to form purified metallized iron nuggets, which are discharged from the furnace.

BRIEF DESCRIPTION OF THE DRAWINGS

The foregoing and other objects will become more readily apparent by referring to the following detailed description and the appended drawings in which:

FIG. 4 is an isometric view of a conditioning material containing a plurality of compounds sprayed onto and forming a vitreous hearth source onto which iron oxide pellets are placed and leveled, specific to the present invention;

FIG. 5 is an isometric view of a conditioning material containing a plurality of compounds placed onto and forming a vitreous hearth surface onto which iron oxide pellets are placed and leveled, specific to the present invention;

FIG. 6 is an isometric view of a plurality of layers of conditioning materials and a coating layer placed on a vitreous hearth layer, with iron oxide pellets placed on top of the coating layer and leveled, specific to the present invention;

FIG. 7 is an isometric view of a plurality of layers of conditioning materials and an additional coating layer placed on a vitreous hearth layer, with iron oxide pellets placed on top of the carbon layer and leveled, specific to the present invention; and FIG. 8 is an isometric schematic view of a discharge mechanism for removing metallized iron from the upper coating layer, specific to the present invention.

DETAILED DESCRIPTION

Figure 1:
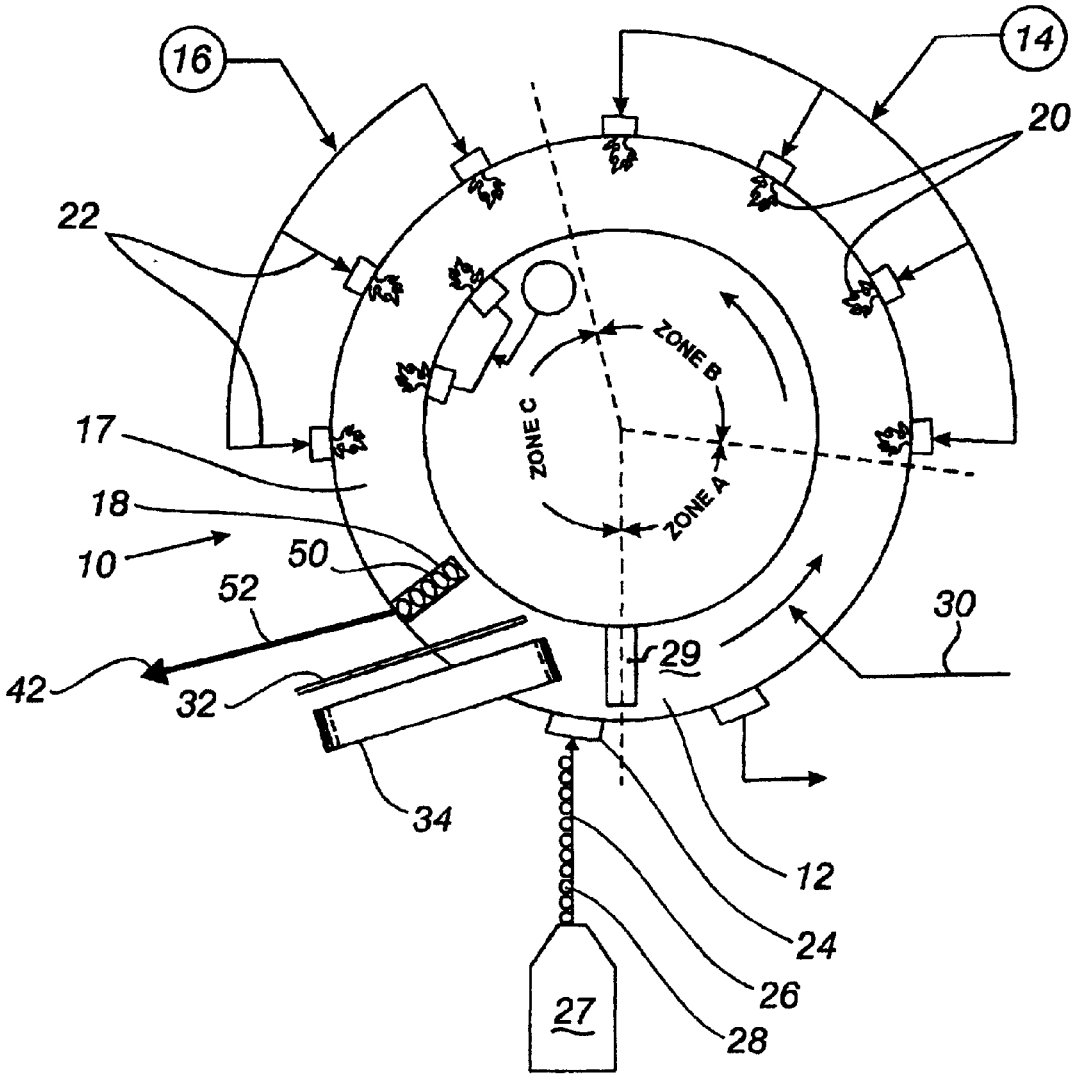
FIG. 1 is a schematic top view of a rotary hearth furnace for the reduction of iron oxide that utilizes a refractory base layer having a vitreous hearth layer with conditioning materials thereon, in accordance the present invention.

Referring now to the drawings, FIG. 1 is a schematic top view of a rotary hearth furnace 10 for the direct reduction of iron oxide. The furnace 10 is depicted as a rotary hearth furnace (RHF) having dimensions preferably ranging from approximately 8 m O.D. (outside diameter) to approximately 56 m O.D., and approximately 5 m I.D. (inside diameter) to approximately 45 m I.D., and an active hearth width of approximately 1 m to approximately 7 m, or wider. The furnace 10 has a rotary hearth 30 that is rotatable from a charge material feed zone 12, through two or more heating and reduction zones 14, 16, and 17 and discharge zone 18. The rotary hearth 30, which has a refractory base layer, is rotatable from the discharge zone 18 to the charge material feed zone 12, and through the zones 12, 14, 16, 17, 18 in a repetitive cycle of operation. The heating or burner zones 14, 16 are each fired by a plurality of air/fuel, coal fired, oil fired, or oxygen enriched burners 20, 22 that may include multiple placements of burners. Off gas from the rotary heat furnace may be removed from a port, as indicated in Zone A.

The placement of vitreous conditioning materials 36 (FIGS. 2 and 2*a*) and a coating layer 38 (FIGS. 3 and 3*a*) are accomplished before placement of the pellets 28 on to the upper layer 38 (FIGS. 3 and 3*a*), with the pellets 28 leveled to a preferred height above the hearth by a leveler 29 that spans the width of the rotary hearth 30. The pellets 28 are continuously fed to the furnace 10 by the feed mechanism 26, as the rotary hearth 30 is rotated around the furnace 10 by a variable speed drive. Therefore, the pellet retention time within the furnace 10 and within each zone 14, 16, 18, is controlled by adjusting the variable speed drive.

Located in the initial area of the material feed zone 12 and upgradient of the feed mechanism 26 from feed hopper 27 for pellets 28, is a means for introducing one or more layers of conditioning material in pellet or powder form or as fluid having suspended material therein, onto the rotary hearth 30.

Figure 2:
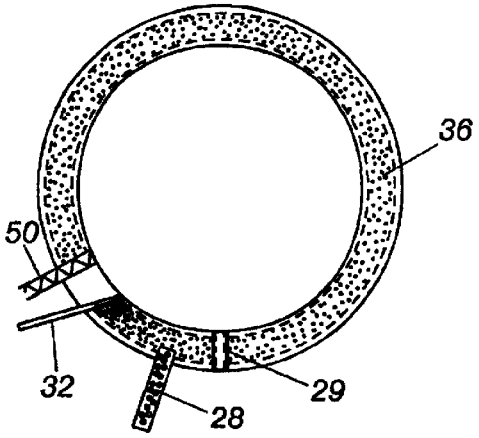
FIG. 2 is a top view of the rotary hearth furnace, top removed, with the introduction of conditioning material onto a refractory base layer by a spray injector or conventional material feed which forms a vitreous hearth layer, specific to the present invention.

FIG. 2 is a top view of the rotary hearth furnace 10 (FIG. 1), top removed, with the introduction of conditioning materials 36 onto the refractory base layer by spray injector 32.

Figure 2A:
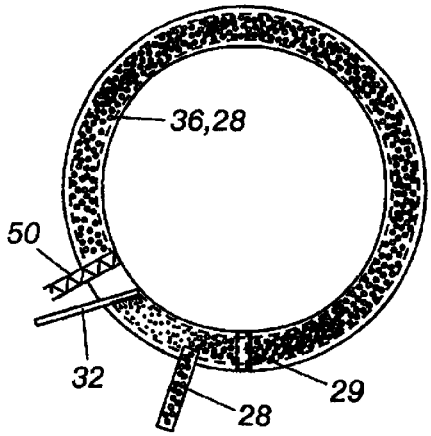
FIG. 2*a* is a top view of the rotary hearth furnace, top removed, with the introduction of iron oxide pellets placed on the vitreous hearth layer, specific to the present invention.

FIG. 2*a* is a top view of the rotary hearth furnace 10 (FIG. 1), top removed, with the introduction of iron oxide pellets 28 placed on the vitreous hearth layer. The means for introducing the conditioning materials 36 and the coating layer onto the rotary hearth 30 (FIG. 1) may include at least one spray injector 32. If the conditioning materials 36 and the coating layer are suspensions, such as compounds mixed with particles, or coke fines which are dispensed in a fluid form, or mixed with organic oils having low sulfur content, then the spray injector 32 may be internally liquid cooled to allow introduction of materials as a liquid spray for application onto the rotary hearth 30 (FIG. 1).

Figure 3:
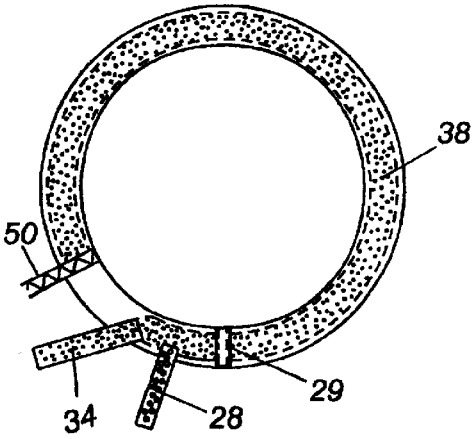
FIG. 3 is a top view of the rotary hearth furnace, top removed, with the placement of conditioning material by a conveyor onto a refractory layer which forms a vitreous hearth layer, specific to the present invention.

FIG. 3 is a top view of the rotary hearth furnace 10 (FIG. 1), top removed, with placement of the conditioning materials 36 (FIGS. 2 and 2*a*) and coating layer 38 by a conveyor onto a refractory layer which forms the vitreous hearth layer.

Figure 3A:
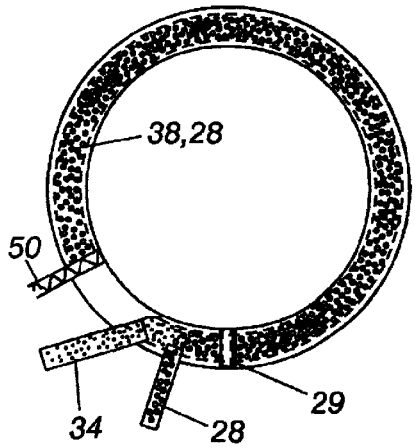
FIG. 3*a* is a top view of the rotary hearth furnace, top removed, with the placement of iron oxide pellets by a conveyor placed on the vitreous hearth layer, specific to the present invention.

FIG. 3*a* is a top view of the rotary hearth furnace 10 (FIG. 1), top removed, with the placement of iron oxide pellets 28 by conveyor placed in the vitreous hearth layer. The means for introducing the conditioning materials 36 (FIGS. 2 and 2*a*) and coating layer 38 onto the rotary heart 30 (FIG. 1) may include at least one solid material conveyor 34. If the conditioning materials 36 (FIGS. 2 and 2*a*) and the coating layer 38 are placed in the furnace 10 (FIG. 1) in solid form, the solid material conveyor 34 places the conditioning materials 36 (FIGS. 2 and 2*a*) and coating layer 38 as close to the refractory base as possible and across the width of the rotary hearth 30 (FIG. 1).

FIG. 4 is an isometric view of the conditioning material 36 containing a plural of compounds sprayed onto and formning a vitreous hearth surface onto which the iron oxide pellets 28 are placed and leveled. The conditioning materials 36 may contain the following compounds: magnesium oxide (MgO), aluminum oxide ($Al_2O_3$), silicon oxide ($SiO_2$), iron oxide compounds ($Fe_3O_4$ and $Fe_2O_3$) and a carbon source.

The rotatable refractory base of the furnace 10 (FIG. 1), having the conditioning materials 36 introduced onto the refractory layer, is heated at temperatures of approximately 1369 degrees Celsius to 1600 degrees Celsius, with a preferred range of heating of approximately 1650 degrees Celsius for forming a vitreous hearth layer. The means for heating the vitreous hearth layer and conditioning materials 36 thereon may include either fixed gas burners, tilting gas burners, or other devices for heating a furnace 10 (FIG. 1) which are located within the furnace enclosure of the burner zones 14, 16 (FIG. 1). After adequate time of heat treatment of the conditioning materials 36, a vitreous hearth layer of a plurality of layers of solidified conditioning material 36 are formed on the refractory base.

FIG. 5 is an isometric view of the conditioning material 36 containing a plurality of compounds placed onto and forming a vitreous hearth surface onto which iron oxide pellets 28 are placed and leveled.

FIGS. 6 and 7 provide an isometric view of a plurality of layers of conditioning material 36 (FIGS. 2 and 2*a*) and a coating layer 38 placed on a vitreous hearth layer 40. Additional coating layers 38, containing carbonaceous materials may be introduced as a mixture by spray injector 32 or by solid material conveyor 34. The coating layer 38 may be introduced into furnace 10 (FIG. 1) as a separate additional layer 44 on the vitreous hearth layer 40. The coating layer 38 may include a mixture of non-wetting graphite, charcoal, coal particulates, fire clay, and/or coke fines which are dispensed in any organic oil having low sulfur content such as diesel or fuel oil and introduced through one or more spray injectors 32. The introduction of both conditioning materials 36 (FIGS. 2 and 2*a*) and the coating layer 38, after repetitive rotations on the rotary hearth 30, provides a heat treated and solidified vitreous hearth layer 40 with an upper coating layer 38 onto which the iron oxide pellets 28 may be placed.

After the conditioning materials 36 (FIGS. 2 and 2*a*) and/or the coating layer 38 are introduced and heat treated on the refractory base, the placement of iron oxide pellets 28 or greenballs onto the vitreous hearth layer 40 occurs by means for placing greenball materials, including iron oxide pellets 28, by screw or vibratory feed conveyor 26 (FIG. 1) or other standard continuous or intermittent belt, or pneumatic or spiral conveyor of pellet sized materials.

The greenballs or iron oxide pellets 28 are heat reduced and moved from the first burner zone 14 (FIG. 1) to a second burner zone 16 (FIG. 1) and to a third burner zone, by the rotary hearth 30. Heating and reducing of the iron oxide to carbon containing iron occurs in the burner zones 14, 16 (FIG. 1) and the reaction zone 17 (FIG. 1). Heat is applied by air/fuel burners to obtain temperatures within the furnace of at least 1369 degrees Celsius to about 1600 degrees Celsius, with a preferred range of at least 1430 degrees Celsius to about 1520 degrees Celsius. During the reducing phase, the vitreous hearth layer 40 of conditioning material 36 (FIGS. 2 and 2*a*) along with coating layer 38 provides a solid, firm surface for the iron oxide pellets 28 placed on the coating layer 38. The conditioning materials 36 (FIGS. 2 and 2*a*) provide a vitreous hearth layer 40 having a high melting temperature and a coating layer 38 provides a non-reactive surface at temperatures utilized to form purified molten iron on the coating layer 38.

A specific benefit of the conditioning material 36 (FIGS. 2 and 2*a*), introduced onto the refractory base, forming a vitreous hearth layer 40, in conjunction with the upper coating layer 38, is that as the iron oxide pellets 28 melt and separate into physically distinct iron and slag regimes, the molten iron remains isolated from the vitreous hearth layer 40 by the coating layer 38. The purified molten iron is not absorbed into the rotary hearth 30 or the vitreous hearth layer 40, thereby producing a purified metallized iron product.

FIG. 8 is an isometric schematic view of a discharge mechanism 50 for removing metallized iron from the upper coating layer 38. Purified nuggets 42 of metallized iron product may be recovered from the discharge zone 18 (FIG. 1) without the formation of a film of metallized iron oxide on the vitreous hearth layer 40 (FIGS. 6 and 7), or other interior surfaces of the furnace 10 (FIG. 1). The vitreous hearth layer 40 (FIGS. 6 and 7) is protected by the carbonaceous upper coating layer 38 placed onto the vitreous hearth layer 40 (FIGS. 6 and 7). The carbon content of the purified iron nuggets 42 may be increased when material such as graphite is introduced into upper coating layer 38. The carbonaceous coating layer 38, or if placed as a separate additional carbon layer 44 (FIG. 7) on top of the coating layer 38, also serves as a non-reactive sacrificial carbon layer which promotes the separation of the iron nuggets 42 from the coating layer 38 or additional carbon layer 44. The sacrificial coating layer 38 and/or additional carbon layer 44 (FIG. 7) may be partially removed during mechanical removal of iron nuggets 42 by the discharge mechanism 50.

In operation, when using the rotary hearth furnace 10 (FIG. 1) the furnace conditioning materials 36 (FIGS. 2 and 2*a*) and the coating layer (FIGS. 3 and 3*a*) may be rejuvenated by the periodic addition of supplemental conditioning materials 36 (FIGS. 2 and 2*a*), coating layers 38 (FIGS. 3 and 3*a*), and/or additional carbon layer 44 (FIG. 7) through any cycles of the furnace 10 (FIG. 1) after the iron nuggets 42 are discharged and before additional iron oxide pellets 28 (FIG. 7) are placed onto the vitreous hearth layer 40 (FIGS. 6 and 7), coating layer 38, or additional carbon layer 44 (FIG. 7) undergoing supplemental conditioning.

SUMMARY OF THE ACHIEVEMENT OF THE OBJECTS OF THE INVENTION

From the foregoing, it is readily apparent that we have invented an apparatus and method of operation for efficiently producing increased volumes and a higher quality of metallized iron product from rotary hearth furnaces without significant increases in cost, processing, time, or excessive furnace temperatures. The present invention is an apparatus and method that produces significantly higher quality of metallized iron product by adding specified amounts of conditioning materials and additional coating layers to a refractory base of a rotary hearth furnace to form a vitreous hearth layer. The present invention solves the problem of loss of purified metallized iron product within the furnace at elevated temperatures and provides iron nuggets having 95% or higher metallized iron.

It is to be understood that the foregoing description and specific embodiments are merely illustrative of modes of invention and the principles thereof, and that various modifications and additions may be made to the apparatus by those skilled in the art, without departing from the spirit and scope of this invention, which is therefore understood to be limited only by the scope of the appended claims.

What is claimed is:

1. A method for producing solid iron and carbon product from iron oxide material containing carbon compounds, comprising the steps of:

(a) providing a furnace, having a refractory surface;

(b) introducing conditioning materials into said furnace and placing said conditioning materials on said refractory surface;

(c) heating said conditioning materials on said refractory surface, forming a vitreous hearth layer;

(d) placing iron oxide materials in said furnace on said vitreous hearth layer;

(e) reducing said iron oxide materials in said furnace, to form metallized iron product;

(f) forming liquid iron and carbon globules, and slag particulates on said vitreous hearth layer, said globules separating from said slag particulates; and (g) discharging solid iron product from said furnace.

2. The method of claim 1, wherein said step of introducing said conditioning materials furnace comprises conditioning said refractory surface with a material selected from the group consisting essentially of magnesium oxide compounds, silicon oxide compounds, iron oxide compounds, aluminum oxide compounds, and carbon compounds.

3. The method of claim 1, wherein said step of placing iron oxide materials is preceded by a step of placing a coating layer of carbon containing compounds onto said vitreous hearth layer.

4. The method of claim 1, wherein said step of heating is followed by a step of placing carbon containing compounds onto said vitreous hearth layer.

5. The method of claim 1, wherein said heating step further comprises heating said conditioning material with a plurality of radiant heat sources at temperatures of about 1370° C. to about 1600° C. inside said furnace.

6. The method of claim 1, wherein said heating step further comprises heating said conditioning materials with a plurality of radiant heat sources at temperatures of about 1530° C. to about 1600° C. inside said furnace.

7. The method of claim 1, wherein said placing step further comprises introducing carbon containing compounds with said iron oxide materials onto said vitreous hearth layer.

8. The method of claim 1, wherein said reducing step further comprises exposing said iron oxide materials to a radiant heat source providing a temperature of about 1430° C. to about 1520° C. inside said furnace.

9. An apparatus for direct reduction of iron oxide material to a solid iron and carbon product, comprising:

(a) a furnace, said furnace having a refractory surface;

(b) means for introducing a layer of conditioning materials onto said refractory surface;

(c) means for heating said conditioning materials layer, forming a vitreous hearth layer;

(d) means for placing iron oxide material onto said vitreous hearth layer;

(e) means for reducing said iron oxide material on said vitreous hearth layer, said means for reducing forms a solid iron and carbon product; and (f) means for removing solid iron and carbon product from said furnace.

10. The apparatus of claim 9, wherein the furnace is a rotary hearth furnace provided with a rotatable refractory surface.

11. The apparatus of claim 9, wherein said means for introducing said layer of conditioning materials comprises an application device selected from the group consisting of a spray apparatus, a screw conveyor, a belt conveyor or a vibrating pan.

12. The apparatus of claim 9, wherein said layer of conditioning materials, comprises a material selected from the group consisting essentially of magnesium oxide compounds, silicon oxide compounds, iron oxide compounds, aluminum oxide compounds, and carbon compounds.

13. The apparatus of claim 9, wherein said means for placing said iron oxide material further comprises means for placing a coating layer on said vitreous hearth layer, said coating layer including carbonaceous compounds that form a layer onto which said iron oxide material is placed.

14. The apparatus of claim 9, wherein said means for placing said iron oxide material comprises a conveyance device, said iron oxide material is positionable by said conveyance device on to said vitreous hearth layer.

15. The apparatus of claim 9, wherein said means for heating comprises a plurality of radiant heat sources providing heat at a temperature range of at least 1369° C. to about 1600° C., said radiant heat sources maintaining said vitreous hearth layer within said temperature range.

16. The apparatus of claim 9, wherein said means for reducing said iron oxide material comprises a plurality of radiant heat sources providing heat at a temperature range of at least 1430° C. to about 1520° C. to said vitreous hearth layer.

17. The apparatus of claim 9, wherein said means for removing solid iron product comprises a collector, said collector removing said iron and carbon product from said vitreous hearth layer.

18. The apparatus of claim 9, wherein said coating layer further comprises a plurality of layers of materials, each successive layer applied on top of a previously introduced layer of materials, said coating layer including carbonaceous compounds.

19. The apparatus of claim 18, wherein said plurality of layers of materials further comprises an additional coating layer of carbonaceous compounds, said additional coating layer placed before said iron oxide material is placed.

20. A method for producing solid iron and carbon product from iron oxide material containing carbon compounds, comprising the steps of:

(a) providing a furnace, said furnace providing a refractory surface;

(b) introducing conditioning materials onto and across said refractory surface;

(c) heating said conditioning materials on said refractory surface, said heating step vitrifying said conditioning materials, forming a vitreous hearth layer;

(d) adding at least one layer of coating compounds on said vitreous hearth layer;

(e) placing said iron oxide material on said at least one layer of coating compounds;

(f) reducing said iron oxide material, said reducing step forming a solid iron and carbon product;

(g) forming liquid iron and carbon globules, and slag particulates on said vitreous hearth layer, said globules separating from said slag particulates; and (h) discharging a solid iron and carbon product from said furnace.

21. The method of claim 20, wherein said introducing step further comprises introducing materials selected from the group consisting essentially of magnesium oxide compounds, silicon oxide compounds, iron oxide compounds, aluminum oxide compounds, and carbon compounds.

22. The method of claim 20, wherein said heating step further comprises heating said conditioning materials with a plurality of radiant heat sources providing heat at a temperature range of at least 1369° C. to about 1600° C. inside said furnace.

23. The method of claim 20, wherein said reducing step further comprises heating said iron oxide material with a plurality of radiant heat sources providing heat at a temperature range of at least 1430° C. to about 1520° C. at said vitreous hearth layer.

24. The method of claim 20, wherein said step of adding at least one layer of coating compounds, further comprises adding coating compounds selected from the group consisting essentially of graphite, charcoal, coal particulates, fire clay, and coke fines.

25. The method of claim 20, wherein said reducing step further comprises heating said iron oxide material, forming nuggets of iron material on top of said at least one layer of coating compounds.

26. A method for producing solid iron and carbon product from iron oxide material containing carbon compounds, comprising the steps of:

(a) providing a furnace, said furnace providing a hearth surface;

(b) adding a plurality of layers of conditioning compounds on said hearth surface;

(c) heating said plurality of layers, said heating step vitrifying said plurality of layers, forming a vitreous hearth layer;

(d) introducing at least one layer of coating materials onto and across said conditioning vitreous layer;

(e) inserting an additional layer of coating compounds onto said coating materials layer;

(f) placing said iron oxide material on said upper layer of carbon compounds;

(g) reducing said iron oxide material, said reducing step forming solid iron and carbon product;

(h) forming liquid iron and carbon globules, and slag particulates on said vitreous hearth layer, said globules separating from said slag particulates; and (i) discharging solid iron and carbon product from said furnace.

27. The method of claim 26, wherein said adding step further comprises placing conditioning materials selected from the group consisting essentially of magnesium oxide compounds, silicon oxide compounds, iron oxide compounds, aluminum oxide compounds, and carbon compounds.

28. The method of claim 26, wherein said heating step further comprises heating said conditioning materials with a plurality of radiant heat sources providing heat at a temperature range of at least 1369° C. to about 1600° C. inside said furnace.

29. The method of claim 26, wherein said heating step further comprises heating said conditioning materials at a temperature range of at least 1530° C. to about 1560° C. inside said furnace.

30. The method of claim 26, wherein said reducing step further comprises heating said iron oxide material with a plurality of radiant heat sources providing heat at a temperature range of at least 1430° C. to about 1520° C. at said vitreous hearth layer.

31. The method of claim 26, wherein said step of introducing at least one layer of coating materials, further comprises adding coating materials selected from the group consisting essentially of graphite, charcoal, coal particulates, fire clay, and coke fines.

32. The method of claim 26, wherein said reducing step further comprises heating said iron oxide material, forming nuggets of iron material on top of said additional coating of carbon compounds onto said vitreous hearth layers.

* * * * *